US005413469A

United States Patent [19]

Nakajima et al.

[11] Patent Number: 5,413,469

[45] Date of Patent: May 9, 1995

[54] THRUST BEARING ARRANGEMENT FOR A DRIVE SHAFT OF A SCROLL COMPRESSOR

[75] Inventors: Nobuyuki Nakajima; Masakuni Ishikawa; Susumu Saito, all of Konan, Japan

[73] Assignee: Zexel Corporation, Tokyo, Japan

[21] Appl. No.: 261,102

[22] Filed: Jun. 16, 1994

[30] Foreign Application Priority Data

Jun. 17, 1993 [JP] Japan ..... 5-171099
Jun. 17, 1993 [JP] Japan ..... 5-171102

[51] Int. Cl.[6] ..... F01C 1/04

[52] U.S. Cl. ..... 418/55.1; 418/94; 384/123; 384/369

[58] Field of Search ..... 418/55.1, 55.4, 55.5, 418/91, 94; 384/123, 369

[56] References Cited

U.S. PATENT DOCUMENTS

| | | | |
|---|---|---|---|
| Re. 33,473 | 12/1990 | Hazaki et al. | 418/55.5 |
| 4,734,020 | 3/1988 | Inaba et al. | 418/94 |
| 5,215,452 | 6/1993 | Yamamura et al. | 418/94 |
| 5,217,359 | 6/1993 | Kawahara et al. | 418/55.4 |

*Primary Examiner*—Richard A. Bertsch
*Assistant Examiner*—Charles G. Freay
*Attorney, Agent, or Firm*—Wenderoth, Lind & Ponack

[57] ABSTRACT

To reduce a load applied to the thrust bearing, to prevent the thrust bearing from seizing and to improve the service life of the thrust bearing, the thrust bearing is provided between a drive shaft and a block to seal a high-pressure side space from a low-pressure side space. By providing an oil supply through hole, one end of which opens into high-pressure side space and the other end of which opens into a space formed by inserting the shaft into the insertion hole, high-pressure lubricating oil can be supplied to the space. The constric within the shaft with the effect of the constriction clearance is formed between the aforementioned oscillating shaft and the insertion hole, and a pressure differential between the two ends of the drive shaft is eliminated. Furthermore, by forming a circular oil groove at a sliding surface where the aforementioned thrust bearing and the drive shaft are in contact with each other and communicating channels that communicate between the circular oil groove and an external circumferential area of the aforementioned thrust bearing, the high-pressure lubricating oil is induced to the circular oil groove and the communicating channels to apply an upward force to the drive shaft.

7 Claims, 3 Drawing Sheets

THRUST BEARING ARRANGEMENT FOR A DRIVE SHAFT OF A SCROLL COMPRESSOR

BACKGROUND OF THE INVENTION

1. Field of the Invention

The present invention relates to a scroll type compressor that changes the volumetric capacity of a compression space formed with a fixed scroll member and an orbiting scroll member to compress the on-board coolant.

2. Description of the Related Art

In scroll type compressors of the prior art, in which a compression space is formed by fitting together a fixed scroll member that is provided with a fixed scroll in the form of a coil and an orbiting scroll member that is provided with an orbiting scroll in the form of a coil wherein the aforementioned orbiting scroll member makes an orbiting movement relative to the fixed scroll member, the volumetric capacity of the aforementioned compression space expands and contracts repeatedly to perform intake, compression and discharge. Thus, the lubrication and sealing of the sliding contact surface between the fixed scroll member and the sliding scroll member are crucial factors.

Accordingly, the scroll type compressor disclosed in Japanese Patent Unexamined Publication No. H3-149391 includes a rotary displacement type oil pump in its structure, so that a sufficient quantity of lubricating oil can be reliably supplied to the bearings regardless of the flow rate of the lubricating oil supplied to the compression work space. With this, a large quantity of lubricating oil can be assured even when high loads are applied to the revolving drive bearing, the eccentric bearing and the first main bearing.

Also, the scroll type compressor disclosed in Japanese Patent Unexamined Publication No. H3-61689 is provided with a cylinder section towards the direction of reciprocal movement of the Oldham's coupling on the wall surface facing opposite the external circumferential surface of the Oldham's coupling which prevents auto rotation of the orbiting scroll member. A liner is provided that moves back and forth within the aforementioned cylinder section in conformance with the operation of the Oldham's coupling to push out the lubricating oil. This structure allows the quantity of supplied oil to be increased as the number of rotations in the drive unit increases.

Likewise, the Japanese Patent Unexamined Publication No. H3-105093 discloses a structure in which a pressurized passage, which is subject to a centrifugal force from the drive shaft, is formed in the drive shaft towards the outside in the direction of the radius of the drive shaft, constituting a so-called centrifugal pump to supply lubricating oil.

However, with the scroll type compressors in the examples quoted above, it is required that a non ferrite material such as aluminum be used for the fixed scroll member and the orbiting scroll member to reduce weight and cost, and a problem arises therefrom. Because of the high back pressure on the orbiting scroll member, it is pressed towards the fixed scroll member, and as a result, the sliding area where the orbiting scroll member and the fixed scroll member are in contact with each other tends to seize, even though the quantity of oil supplied to the sliding contact surface is increased.

Thus, it is necessary to reduce the back pressure applied to the orbiting scroll member.

Also, since the drive shaft is provided over the high-pressure side, where a drive means is provided, through the low-pressure or intermediate drive side where the orbiting scroll member is provided, a force is constantly applied towards the orbiting scroll member side by the pressure differential between the high-pressure and low-pressure regions or the pressure differential between the high-pressure and intermediate pressure regions. Because of this, it is required that a bearing (thrust bearing) be provided at the end of the drive shaft to receive the load applied by this force.

However, when the load is large, the thrust bearing itself can seize, and as the load is applied constantly, the service life of the thrust bearing is shortened.

SUMMARY OF THE INVENTION

The object of the present invention is to provide a scroll type compressor in which the load on the thrust bearing is reduced, seizure of the thrust bearing is prevented and the service life of the thrust bearing is extended.

In order to achieve this object, the present invention is a scroll type compressor that comprises; an electric motor that is provided in a high pressure space within a sealed case, and a stator that is fixed within the sealed case, a rotor that is secured to the drive shaft. An orbiting shaft is formed as a decentered extension of the aforementioned drive shaft. An orbiting scroll member is provided with an insertion hole into which the orbiting shaft is fitted, and a fixed scroll member fits by interlocking with the orbiting scroll member to form a compression space. A block holds the orbiting scroll member between the fixed scroll member and the block in such a manner that it can orbit freely against the fixed scroll member, and is provided with a through hole that accommodates a main bearing, which holds the aforementioned drive shaft. An toroidal thrust bearing is provided under the aforementioned through hole and between the drive shaft and the block, and supports the aforementioned drive shaft in such a manner that it can rotate freely and, at the same time, seals off the high pressure side that communicates with the oil reservoir that is formed in the lower section of the high-pressure space from the low pressure side, where the aforementioned orbiting scroll member orbits. An oil supply through hole has one end which opens into the high-pressure side space that is sealed off by the aforementioned thrust bearing and another end which opens into the space within the shaft formed by inserting the orbiting shaft into the aforementioned insertion hole.

Therefore, in the present invention, since the high-pressure side space and the low-pressure side space are sealed off from each other by the thrust bearing provided between the drive shaft and the block, and since the oil supply through hole is provided with one end opening into the high-pressure side space that is sealed off by the thrust bearing and the other end opening into the space within the shaft, high-pressure lubricating oil can be supplied to the end of the orbiting shaft via the oil supply through hole, eliminating the pressure differential between the upper end and the lower end of the drive shaft. Consequently, the load on the thrust bearing is reduced, the thrust bearing is prevented from seizing and the durability of the thrust bearing is improved.

Also, in order to achieve the object, the present invention is a scroll type compressor that comprises; an electric motor that is provided in a high pressure space within a sealed case, a stator that is fixed within the sealed case, a rotor that is secured to the drive shaft, an orbiting shaft, which is formed as a decentered extension of the drive shaft, an orbiting scroll member is provided with an insertion hole into which the orbiting shaft is fitted, and a fixed scroll member fits by interlocking with the orbiting scroll member to form a compression space. A block holds the orbiting scroll member between the fixed scroll member and the block in such a manner that it can orbit freely against the fixed scroll member, and is provided with a through hole that accommodates the main bearing, which holds the aforementioned drive shaft. A toroidal thrust bearing is provided under the aforementioned through hole and between the drive shaft and the block which supports the aforementioned drive shaft in such a manner that it can rotate freely and which, at the same time, seals off the high pressure side that communicates with the oil reservoir formed in the lower section of the high-pressure space from the low pressure side, where the aforementioned orbiting scroll member oscillates. The thrust bearing is further provided with a circular oil groove formed on the sliding contact surface of the thrust bearing where it is in contact with the drive shaft and communicating channels that communicate between the circular oil groove and the external circumferential side surface of the aforementioned thrust bearing.

As a result, with the toroidal thrust bearing provided between the drive shaft and the block to receive the load applied to the aforementioned drive shaft, which is in turn provided with a circular oil groove formed on the sliding surface that comes in contact with the drive shaft and communicating channels that communicate between this circular oil groove and the external circumferential side surface, high-pressure lubricating oil can be supplied from the aforementioned high-pressure side space to the aforementioned circular oil groove via the communicating channels, and the upward force applied to the drive shaft can be increased, reducing the load to a degree equivalent to this applied force. Consequently, seizure of the thrust bearing is prevented and the durability of the thrust bearing is improved.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

The following is an explanation of the preferred embodiments, with reference to the drawings.

Figure 1:
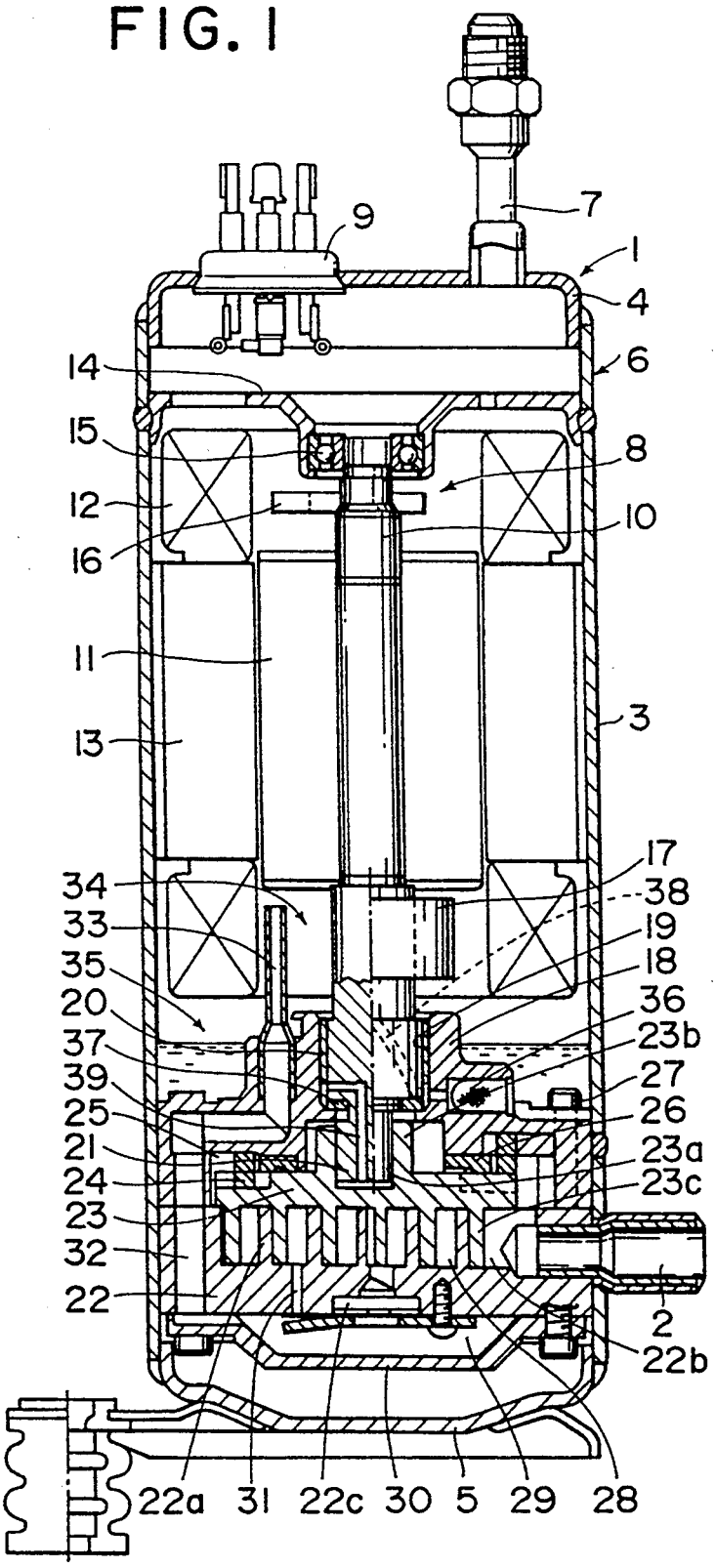
FIG. 1 is a cross section showing an outline of a scroll type compressor in an embodiment of the present invention.
Figure 2:
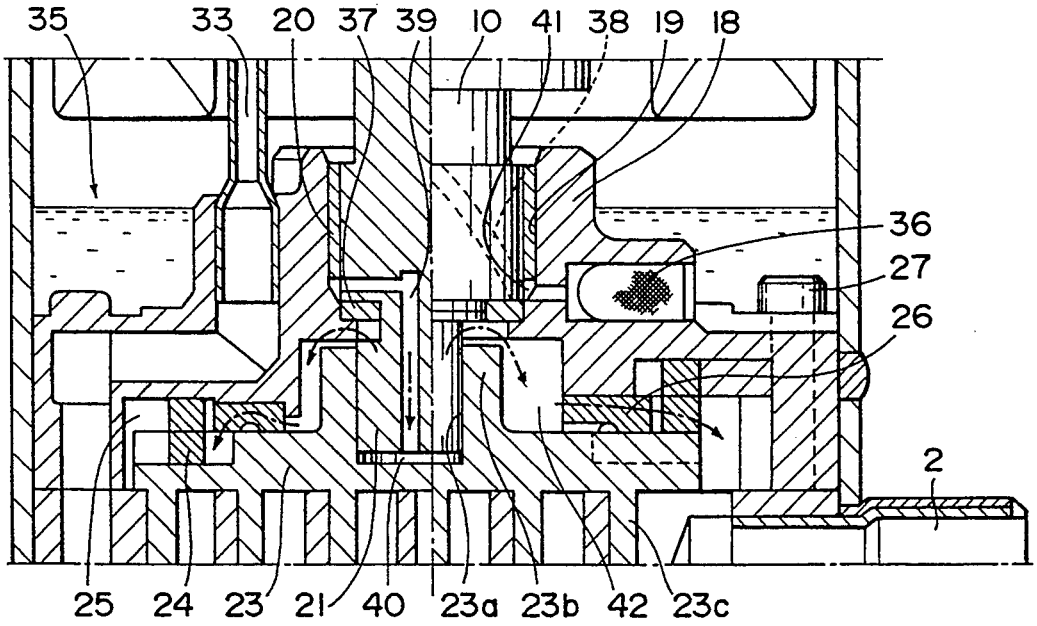
FIG. 2 is an enlarged partial cross section of a thrust bearing area of the scroll type compressor in the embodiment of the present invention.

In a scroll type compressor 1 shown in FIG. 1 and FIG. 2, a sealed case 6 is structured with a cylindrical member 3 that is provided with a coolant intake port 2, a cap member 4 that seals the upper end of the cylindrical member 3, and a base member 5 that seals the lower end of the cylindrical member 3. Note that the cap member 4 is provided with a coolant outlet port 7 and a power supply terminal 9 for a electric motor 8.

The electric motor 8 may be, for example, a DC brushless motor provided with a drive shaft 10, a rotor 11 which is secured onto the drive shaft 10 and which is surrounded by a permanent magnet and a stator 13, which is secured onto the internal circumferential surface of the cylindrical member 3 and wrapped by a coil winding 12. The drive shaft 10 is held by a drive shaft holding member 14 via a bearing 15 in such a manner that it can turn freely. It is provided with an upper balance weight 16 near its upper end. The rotor 11 is secured below the upper balance weight 16. Below the rotor 11, a lower balance weight 17 is secured, and the lower portion of the balance weight 17 is inserted in a through hole 19 that is formed in a block 18, the details of which will be explained below. The lower portion of the balance weight 17 is held by a main bearing 20 so that it can rotate freely. Projecting from the lower end of the drive shaft 10, is an eccentric shaft 21 that is provided off center of the drive shaft.

The block 18 is secured to the internal circumferential surface of the aforementioned cylindrical member 3 and is provided with the through hole 19, which is formed by piercing the center. A fixed scroll member 22, details of which will come later, is secured with a bolt 27 to the lower end surface of the block 18, and with this, an orbiting scroll member 23, also to be explained later, is clamped in such a manner that it can orbit freely. Also, in order to hold the drive shaft 10, in addition to the main bearing 20, a thrust bearing 37, to be explained later, is provided between the drive shaft 10 and block 18. Note that the diameter of the lower section of the aforementioned through hole 19 is increased so that a projected portion **23*b* of the orbiting scroll member 23, where an insertion hole 23*a*** is formed, can make its orbiting motion.

An oldham's-ring housing groove 25 is formed on the surface of the block 18 where the orbiting scroll member 23 slides to contain an oldham's ring 24, which prevents the orbiting scroll member 23 from rotating. A scroll bearing 26, which is provided with a lubricating oil groove with an appropriate constriction formed in it, is also provided on this sliding surface.

The orbiting scroll member 23 is provided with the projected portion **23*b* formed at the center of its upper end surface. The insertion hole 23*a* is formed in the projected portion 23*b*, into which the orbiting shaft 21 is fitted. An orbiting scroll 23*c* is formed in a coil shape on the lower end surface of the orbiting scroll member 23**.

The fixed scroll member 22 is provided with a fixed scroll **22*a*, formed in a coil shape, which interlocks with the aforementioned orbiting scroll 23*c* to form a compression space 28. An intake chamber 22*b* is provided on one side between the aforementioned coolant intake port 2 and the forward end of the compression space 28. The coolant outlet 22*c* is also provided at the center of the lower end surface, and communicates with the last level of the compression space 28. A cover 30, which forms a the coolant outlet passage 29, is secured onto the lower end surface of the fixed scroll member 22. Note that in the area of the middle level of the aforementioned compression space 28, a bypass channel 31 is provided which communicates between the compression space 28 and the aforementioned coolant outlet passage 29. It is opened if the pressure inside the compression space 28 exceeds a specific value. When the electric motor 8 is driven in the scroll type compressor 1, structured as described above, the orbiting scroll member 23 secured decentered to the drive shaft 10 of the electric motor 8, makes an orbiting motion relative to the fixed scroll member 22 and the compression space 28, formed by the orbiting scroll 23***c* and the fixed scroll 22*a*, gradually reduces its volumetric capacity from the intake side to the outlet side. The coolant taken in through the coolant intake port 2 is compressed and then discharged from the coolant outlet 22*c* into the coolant outlet passage 29. Then it passes through a coolant conduit 32, which is a continuous passage through the fixed scroll member 22 and the block 18, passes through a extended pipe 33 mounted on the block 18, reaches a space (high pressure chamber) 34 where the aforementioned electric motor 8 is provided and is sent out via the coolant outlet port 7 to the next process in the cooling cycle.

Also, in this high pressure chamber 34, the lubricating oil that has been separated by the rotation of the electric motor 8 is stored in an oil reservoir 35 that is formed over the block 18. The lubricating oil thus stored in the oil reservoir 35 flows from a lubricating oil intake port 36 to a high-pressure side space 41 over the aforementioned thrust bearing 37 due to the difference in pressure between the high pressure and the low pressure on the intake side of the compression space 28, because the lubricating oil is subject to the pressure of the aforementioned high-pressure chamber 34.

The lubricating oil which has flowed into the high-pressure side space 41, while lubricating the main bearing 20, is divided to follow two different paths. One path is the passage up the oil supply groove 38, formed on an incline on the external circumferential surface of the drive shaft 10, so the oil will reach the upper end. The other passage passes the oil supply through the hole 39 from the high-pressure side space 41 over the thrust bearing 37 and travels to a space 40 within the shaft formed by the end of the aforementioned eccentric shaft 21 and the insertion hole 23*a*. In the first passage, the lubricating oil flows out to the outside from the upper end of the oil supply groove 38 and returns to the oil reservoir 35.

In the second passage, because of the constricting effect of the clearance formed by the external circumferential surface of the aforementioned eccentric shaft 21 and the internal circumferential surface of the insertion hole 23*a*, the pressure in the space 40 within the shaft is maintained at a high level. Also, in this second passage, the lubricating oil passes through the clearance and reaches the low-pressure side space 42, which is beneath the thrust bearing 37, while lubricating the sliding area of the external circumferential surface of the eccentric shaft 21 and the internal circumferential surface of the insertion hole 23*a*.

The pressure in the aforementioned low-pressure side space 42 is controlled at an intermediate or low pressure through the constricting effect of the clearance between the insertion hole 23 and the eccentric shaft 21 on the upstream side and the constricting effect of the narrow portion formed in the aforementioned scroll bearing 26 on the downstream side, and the quantity of lubricating oil traveling to the oldham's ring housing groove via the scroll bearing 26 can be adjusted with the pressure differential between the pressure on the high-pressure side and the low pressure on the intake side. The lubricating oil which has traveled to the oldham's ring housing groove 25 then travels, after lubricating the oldham's-ring 24, to the intake chamber 22*b* formed in the fixed scroll member 22. From the intake chamber 22*b* the lubricating oil is carried along with the coolant into the compression space 28 where it lubricates and seals the compression space 28.

Therefore, since the pressure in the space 40 within the shaft is maintained at a high level by the effect of the constriction of the clearance formed by the external circumferential surface of the aforementioned eccentric shaft 21 and the internal circumferential surface of the insertion hole 23*a*, high upward pressure is applied to the eccentric shaft 21. Consequently, the downward load applied to the drive shaft 10 can be reduced, reducing the load on the thrust bearing 37.

As has been explained so far, the high-pressure side and the low-pressure side are sealed off from each other with the thrust bearing 37 provided between the drive shaft 10 and the block 18. The oil supply through hole 39 has one end of which opens into the high-pressure side, which is sealed off by the aforementioned thrust bearing 37, and the other end which opens into the space 40 within the shaft formed with the end of the eccentric shaft 21, which extends decentered from the drive shaft. The insertion hole 23*a*, into which the eccentric shaft 21 is fitted, has a specific constriction created in the circular clearance formed between the aforementioned eccentric shaft 21 and the aforementioned insertion hole 23*a*. Thus high-pressure lubricating oil can be supplied to the end of the eccentric shaft 21 via the oil supply through hole 39, eliminating the pressure differential between the upper end and the lower end of the drive shaft 10. As a result, the load applied to the thrust bearing 37 is reduced, seizure of the thrust bearing is prevented and the durability of the thrust bearing is improved.

Figure 5:
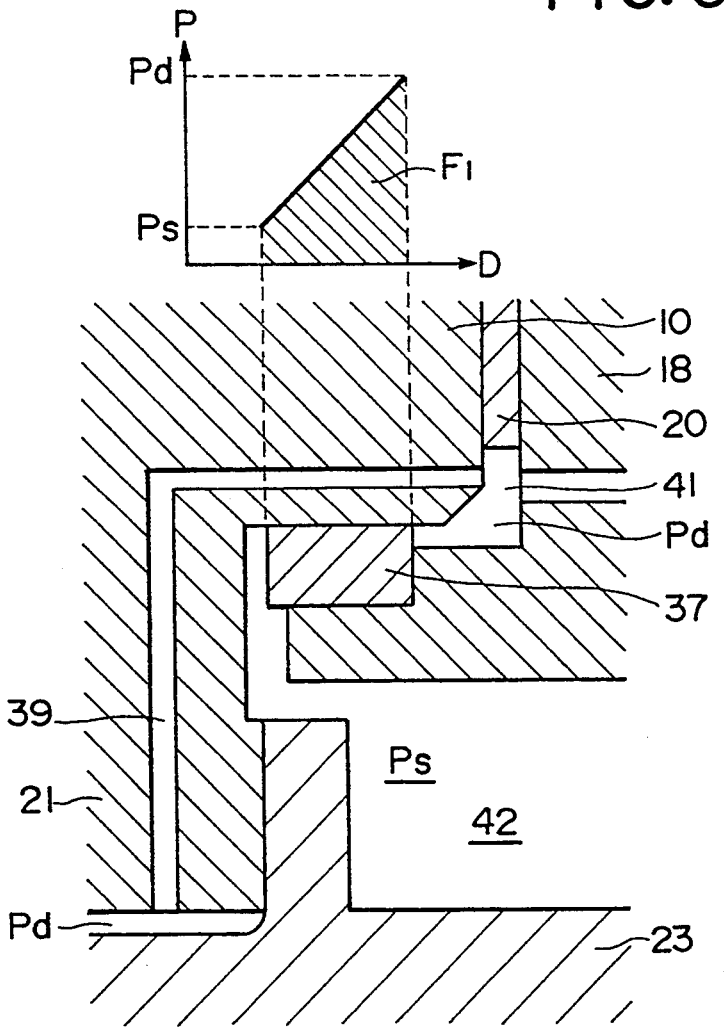
FIG. 5 is an explanatory diagram illustrating the applied force when no circular oil groove or communicating channel is provided.

Also, in the structure described above, pressure on the aforementioned thrust bearing 37 is decreased gradually and linearly from a high-pressure Pd due to the lubricating oil supplied to the high-pressure side space 41, to an intermediate pressure Ps on the low-pressure side space 42, as shown in FIG. 5. This pressure applies an upward force to the drive shaft 10, as indicated by F1. Because of this, by increasing this applied force, the load applied to the thrust bearing 37 can be further reduced.

Figure 3:
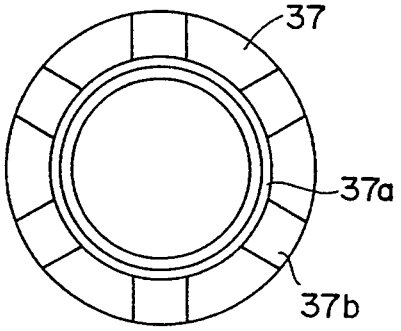
FIG. 3 is a plan view showing an example of the thrust bearing according to the present invention.
Figure 6:
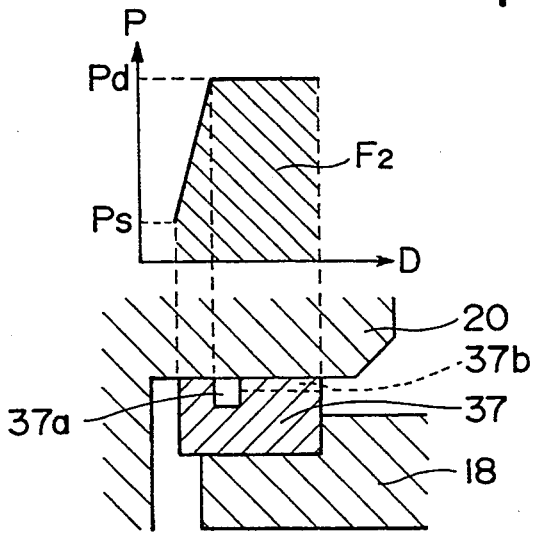
FIG. 6 is an explanatory diagram illustrating the applied force when a circular oil groove and a communicating channel are provided.

For this reason, the toroidal thrust bearing 37 is provided with a circular oil groove 37*a*, formed at a specific position on the sliding surface that comes in contact with the drive shaft 10, and is also provided with a plurality of communicating channels 37*b* that are formed in a radial pattern and that communicate between the circular oil groove 37*a* and the external circumferential surface of the aforementioned thrust bearing 37 as shown in FIG. 3. Since the high pressure Pd can be induced to the communicating channels 37*b* and the circular oil groove 37*a* and the high pressure Pd can be maintained on the surface where the thrust bearing 37 and the drive shaft 10 come in contact through the circular oil groove 37*a*, as shown in FIG. 6, an applied force F2 can be achieved.

Figure 4:
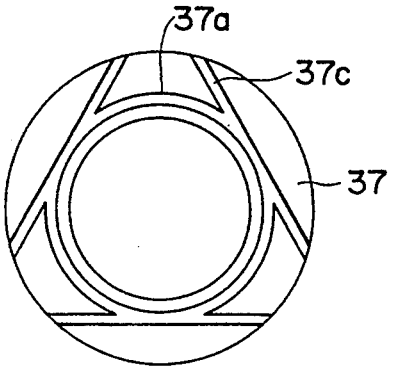
FIG. 4 is a plan view showing another example of the thrust bearing according to the present invention.

FIG. 4 shows an example of the thrust bearing 37 in which a plurality of communicating channels 37*c* are formed in a tangential direction to, and extending from the circular oil groove 37*a*, that is formed in the thrust bearing 37. With the communicating channels 37*c*, the lubricating oil can be supplied in the direction of the rotation of the drive shaft 10, achieving a lubricating effect on the sliding surface where the thrust bearing comes in contact with the drive shaft 10 as well as the advantages described earlier.

With the toroidal thrust bearing 37 as has been described so far, which is provided between the drive shaft 10 and the block 18, and which receives the load applied to the aforementioned drive shaft 10, and which is provided with the circular oil groove 37*a* and the communicating channels 37*b*, 37*c*, which extend from the circular oil groove 37*a* to the external circumferential surface to assure a supply of high-pressure lubricating oil from the aforementioned lubricating oil intake port 36 to the aforementioned circular oil groove 37*a* via these communicating channels 37*b*, 37*c*, the upward force that is applied to the drive shaft at the contact surface where the thrust bearing 37 and the drive shaft 10 are in contact can be increased, resulting in a reduction in the load on the thrust bearing 37. Consequently, seizure of the thrust bearing 37 is prevented and the durability of the thrust bearing 37 is also improved.

What is claimed is:

1. A scroll compressor, comprising:

a sealed case having a high pressure space and a low pressure space in said sealed case;

an electric motor in said high pressure space of said sealed case comprising a stator fixed in said sealed case and a rotor rotatably mounted in said sealed case, said rotor being fixed with a drive shaft;

an eccentric shaft that extends from and is axially decentered with respect to said drive shaft;

an orbiting scroll member having an insertion hole therein into which said eccentric shaft is fitted, said eccentric shaft and said orbiting scroll member having a space defined therebetween in said insertion hole and said orbiting scroll member being located in said low pressure space;

a fixed scroll member fixed in said sealed casing and positionally related to said orbiting scroll member so as to form a compression space therewith;

a block having a hole therein accommodating a main bearing, said main bearing holding said drive shaft, and said block holding said orbiting scroll member such that said orbiting scroll member is orbitally moveable between said block and said fixed scroll member;

an oil reservoir in a lower area of said high pressure space;

a thrust bearing located between said block and said drive shaft so as to rotatably support said drive shaft, said thrust bearing communicating with a high pressure side space that communicates with said oil reservoir, and said thrust bearing sealing said high pressure side space from said low pressure space; and an oil supply through hole having one end open to said high pressure side space and another end open to said space defined between said eccentric shaft and said orbiting scroll member.

2. The scroll compressor of claim 1, wherein said thrust bearing comprises a sliding surface in contact with said drive shaft, an external circumferential side surface, a circular oil groove formed on said sliding surface of said thrust bearing and communicating channels extending between said circular oil groove and said external circumferential side surface.

3. The scroll compressor of claim 2, wherein said communicating channels are in a radial pattern on said sliding surface extending between said circular oil groove and said external circumferential side surface.

4. The scroll compressor of claim 2, wherein said communicating channels extend tangentially to said circular oil groove between said circular oil groove and said external circumferential side surface of said thrust bearing.

5. A scroll compressor, comprising:

a sealed case having a high pressure space in said sealed case and a low pressure space in said sealed case;

an electric motor in said high pressure space of said sealed case comprising a stator fixed in said sealed case and a rotor rotatably mounted in said sealed case, said rotor being fixed with a drive shaft;

an eccentric shaft that extends from and is axially decentered with respect to said drive shaft;

an orbiting scroll member having an insertion hole therein into which said eccentric shaft is fitted, and said orbiting scroll member being located in said low pressure space;

a fixed scroll member fixed in said sealed casing and positionally related to said orbiting scroll member so as to form a compression space therewith;

a block having a hole therein accommodating a main bearing, said main bearing holding said drive shaft, and said block holding said orbiting scroll member such that said orbiting scroll member is orbitally moveable between said block and said fixed scroll member;

an oil reservoir in a lower area of said high pressure space;

a thrust bearing located between said block and said drive shaft so as to rotatably support said drive shaft, said thrust bearing communicating with a high pressure side space that communicates with said oil reservoir, said thrust bearing sealing said high pressure side space from said low pressure space, and said thrust bearing comprising a sliding surface in contact with said drive shaft, an external circumferential side surface, a circular oil groove at said sliding surface and communicating channels extending between said circular oil groove and said external circumferential side surface of said thrust bearing.

6. The scroll compressor of claim 5, wherein said communicating channels are in a radial pattern on said sliding surface extending between said circular oil groove and said external circumferential side surface.

7. The scroll compressor of claim 5, wherein said communicating channels extend tangentially to said circular oil groove between said circular oil groove and said external circumferential side surface of said thrust bearing.

* * * * *